US008933383B2

(12) United States Patent
Celmins

(10) Patent No.: US 8,933,383 B2
(45) Date of Patent: Jan. 13, 2015

(54) METHOD AND APPARATUS FOR CORRECTING THE TRAJECTORY OF A FIN-STABILIZED, BALLISTIC PROJECTILE USING CANARDS

(75) Inventor: Ilmars Celmins, Whiteford, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 605 days.

(21) Appl. No.: 12/924,035

(22) Filed: Sep. 1, 2010

(65) Prior Publication Data

US 2013/0334358 A1 Dec. 19, 2013

(51) Int. Cl.
*F42B 15/01* (2006.01)

(52) U.S. Cl.
USPC ..... 244/3.24; 244/45 A

(58) Field of Classification Search
USPC ..... 244/3.24, 3.28, 3.29, 3.3, 45 A, 46, 48
See application file for complete search history.

(56) References Cited

U.S. PATENT DOCUMENTS

| | | | | | |
|---|---|---|---|---|---|
| 2,601,962 | A * | 7/1952 | Douglas | 244/201 |
| 3,063,375 | A * | 11/1962 | Hawley et al. | 244/3.27 |
| 4,029,270 | A * | 6/1977 | Niemeier | 244/3.21 |
| 4,512,537 | A * | 4/1985 | Sebestyen et al. | 244/3.21 |
| 4,568,039 | A * | 2/1986 | Smith et al. | 244/3.15 |
| 4,660,786 | A * | 4/1987 | Brieseck et al. | 244/3.24 |
| 4,709,877 | A * | 12/1987 | Goulding | 244/3.28 |
| 5,085,380 | A | 2/1992 | Barton | |
| 5,235,930 | A * | 8/1993 | Pendleton | 114/312 |
| 5,333,570 | A * | 8/1994 | DuBois et al. | 114/144 R |
| 5,393,012 | A * | 2/1995 | Dunn | 244/3.23 |
| 5,398,886 | A * | 3/1995 | Surman | 244/3.21 |
| 5,423,497 | A * | 6/1995 | Ransom | 244/3.22 |
| 5,439,188 | A * | 8/1995 | Depew et al. | 244/3.21 |
| 5,467,940 | A * | 11/1995 | Steuer | 244/3.11 |
| 5,775,636 | A * | 7/1998 | Vig et al. | 244/3.24 |
| 6,748,871 | B2 * | 6/2004 | Hellman | 102/490 |
| 6,764,044 | B2 * | 7/2004 | Kusic | 244/78.1 |
| 6,880,478 | B2 * | 4/2005 | Schmitz et al. | 114/162 |
| 7,163,176 | B1 * | 1/2007 | Geswender et al. | 244/3.27 |
| 7,325,769 | B1 * | 2/2008 | Harnisch et al. | 244/3.28 |
| 7,354,017 | B2 * | 4/2008 | Morris et al. | 244/3.23 |
| 7,412,930 | B2 * | 8/2008 | Smith et al. | 102/473 |
| 7,475,846 | B2 * | 1/2009 | Schroeder | 244/3.26 |
| 7,755,012 | B2 * | 7/2010 | Mock | 244/3.23 |
| 7,902,489 | B2 * | 3/2011 | Sirimarco et al. | 244/3.21 |
| 2003/0094536 | A1 * | 5/2003 | LaBiche | 244/2 |
| 2004/0011919 | A1 * | 1/2004 | Johnsson et al. | 244/3.29 |
| 2004/0021034 | A1 * | 2/2004 | Hellman | 244/3.28 |
| 2005/0056723 | A1 * | 3/2005 | Clancy et al. | 244/3.24 |
| 2006/0071120 | A1 * | 4/2006 | Selin et al. | 244/3.27 |
| 2007/0084961 | A1 * | 4/2007 | Johnsson et al. | 244/3.28 |

(Continued)

*Primary Examiner* — Tien Dinh
*Assistant Examiner* — Michael A Fabula
(74) *Attorney, Agent, or Firm* — Christos S. Kyriakou

(57) ABSTRACT

A system and method of trajectory correction includes a voice coil coupled to the projectile and providing a linear force; a linkage assembly coupled to the voice coil and comprising: a linkage shaft; a slot coupled to the linkage shaft; and a pin loosely coupled to the slot to form a first pivot point, wherein the linkage assembly converts the linear force to a torque force through the first pivot point; and a canard assembly coupled to the linkage assembly and including a canard shaft coupled to the linkage shaft to form a second pivot point; and at least one canard coupled to the canard shaft, wherein the torque force is transmitted to canard shaft by the linkage shaft, and wherein the canard shaft transmits the torque force to the canard to correct the trajectory of the projectile.

11 Claims, 9 Drawing Sheets

(56) References Cited

U.S. PATENT DOCUMENTS

| | | | | |
|---|---|---|---|---|
| 2008/0001023 | A1* | 1/2008 | Schroeder | 244/3.24 |
| 2008/0029642 | A1* | 2/2008 | Harnisch et al. | 244/3.28 |
| 2009/0014595 | A1* | 1/2009 | Rougelot et al. | 244/228 |
| 2009/0090809 | A1* | 4/2009 | Ronn et al. | 244/3.28 |
| 2009/0218437 | A1* | 9/2009 | Sirimarco et al. | 244/3.21 |
| 2010/0019083 | A1* | 1/2010 | Llamas Sandin et al. | 244/99.14 |
| 2010/0147992 | A1* | 6/2010 | Mock | 244/3.22 |
| 2010/0212568 | A1* | 8/2010 | Zanfei | 114/144 RE |
| 2010/0275805 | A1* | 11/2010 | Rastegar et al. | 102/501 |
| 2011/0297783 | A1* | 12/2011 | Martinez | 244/3.21 |
| 2012/0175458 | A1* | 7/2012 | Geswender | 244/3.24 |
| 2012/0175459 | A1* | 7/2012 | Geswender et al. | 244/3.24 |
| 2013/0074623 | A1* | 3/2013 | Rastegar et al. | 74/110 |

* cited by examiner

METHOD AND APPARATUS FOR CORRECTING THE TRAJECTORY OF A FIN-STABILIZED, BALLISTIC PROJECTILE USING CANARDS

GOVERNMENT INTEREST

The embodiments herein may be manufactured, used, and/or licensed by or for the United States Government without the payment of royalties thereon.

BACKGROUND OF THE INVENTION

1. Technical Field

The embodiments herein generally relate to launched projectiles and, more particularly, to correcting the flight path of a fin-stabilized projectile.

2. Description of the Related Art

Modern warfare is based on mission speed, high per round lethality, and low possibility of collateral damage. Achieving these objectives requires high precision. Unguided artillery shells follow a ballistic trajectory, which is generally predictable but practically results in larger misses at longer ranges due to variations in atmospheric conditions including wind speed and direction, temperature and precipitation, and variations in the weapons system including manufacturing tolerances, barrel condition, propellant charge temperature, and gun laying errors. As the ballistic range increases, the potential impact of the projectile variation grows until the projectile delivered lethality is too low or the risk of collateral damage is too high to effectively execute the fire mission.

Precision in such weapons traditionally comes at a high cost. The missile community has developed and matured means to alter the trajectory of a missile in flight. These conventional methods generally involve relatively sophisticated mechanisms, resulting in costly solutions. Mechanically, these systems are not compatible with spin-stabilized flight vehicles, where spin rates are at least an order of magnitude higher and launch accelerations are several orders of magnitude higher. Cost breakdowns for current precision munitions indicate that the actuator system is a cost driver for the munition.

BRIEF SUMMARY OF THE INVENTION

In view of the foregoing, an embodiment herein provides a system for correcting a trajectory of a projectile that includes: a voice coil coupled to the projectile and providing a linear force; a linkage assembly coupled to the voice coil, the linkage assembly includes: a linkage shaft; a slot coupled to the linkage shaft; and a pin loosely coupled to the slot to form a first pivot point, wherein the linkage assembly converts the linear force to a torque force through the first pivot point; and a canard assembly coupled to the linkage assembly, the canard assembly including: a canard shaft coupled to the linkage shaft to form a second pivot point; and at least one canard coupled to the canard shaft, wherein the torque force is transmitted to canard shaft by the linkage shaft, and wherein the canard shaft transmits the torque force to the canard to correct the trajectory of the projectile.

In such a system, the projectile may include voice coil supports that support the voice coil in an axial direction. Furthermore, the linkage assembly may comprise a voice coil shaft comprising a first end and a second end, wherein the voice coil shaft is coupled to the voice coil to form a third pivot point, and wherein the voice coil shaft is coupled to the voice coil at the first end and coupled to the linkage shaft at the second end using the pin and the slot. In addition, the linkage assembly may comprise a flexing linkage member comprising a first end and a second end, and wherein the flexing linkage member is coupled to the voice coil at the first end and coupled to the linkage shaft at the second end using the pin and the slot. Moreover, the voice coil may comprise a rack and the linkage assembly comprises a pinion, wherein the rack mates with the pinion, and wherein the canard shaft rotates upon articulation of the voice coil. Additionally, the canard shaft may comprise a flat plate coupled to the linkage shaft. The canard assembly may also comprise a support surface, wherein the support surface comprises at least a pair of nubs, and wherein the flat plate is wedged between the pair of nubs and rocks between the pair of nubs upon articulation of the voice coil.

In such a system, the canard shaft may also comprise a cylindrical shaft coupled to the linkage shaft. Furthermore, the canard assembly may comprise: a plurality of elastically deformable bearing blocks coupled to the canard shaft; and a plurality of support blocks proximate to the plurality of bearing blocks thereby creating a clearance gap between the plurality of bearing blocks and the plurality of support blocks. Moreover, the plurality of bearing blocks may deform under high g acceleration to bridge the clearance gap between the plurality of bearing blocks and the plurality of support blocks. Additionally, the canard shaft may be supported by the support blocks.

An embodiment herein further provides an apparatus for actuating canards on a projectile, the apparatus comprising: a voice coil coupled to the projectile and providing a linear force; a linkage assembly coupled to the voice coil, the linkage assembly comprising: a linkage shaft; a slot coupled to the linkage shaft; and a pin loosely coupled to the slot to form a first pivot point, wherein the linkage assembly converts the linear force to a torque force through the first pivot point; and a canard assembly coupled to the linkage assembly, the canard assembly comprising: a cylindrical canard shaft coupled to the linkage shaft; and at least one canard coupled to the canard shaft, wherein the torque force is transmitted to canard shaft by the linkage shaft, and wherein the canard shaft transmits the torque force to the canard to correct the trajectory of the projectile.

In such an apparatus, the linkage assembly may comprise a voice coil shaft comprising a first end and a second end, wherein the voice coil shaft is coupled to the voice coil to form a third pivot point, and wherein the voice coil shaft is coupled to the voice coil at the first end and coupled to the linkage shaft at the second end via the pin and the slot. Furthermore, the linkage assembly may comprise a flexing linkage member comprising a first end and a second end, and wherein the flexing linkage member is coupled to the voice coil at the first end and the linkage shaft at the second end via the pin and the slot. Moreover, the voice coil may comprise a rack and the linkage assembly comprises a pinion, wherein the rack mates with the pinion, and wherein the canard shaft rotates upon articulation of the voice coil. In addition, the canard assembly may be locked during a launch event by locking the canards to prevent movement of the canards, and wherein after the launch event, the canard assembly is unlocked and thereby allows movement of the canards via the rotation of the canard shaft.

Furthermore, in such an apparatus, the canard assembly may comprise: a plurality of elastically deformable bearing blocks coupled to the canard shaft; and a plurality of support blocks proximate to the plurality of bearing blocks thereby creating a clearance gap between the plurality of bearing blocks and the plurality of support blocks. Moreover, the plurality of bearing blocks may deform under high g acceleration to bridge the clearance gap between the plurality of bearing blocks and the plurality of support blocks. In addition, the canard shaft may be supported by the support blocks.

An embodiment herein also provides a method of actuating canards on a projectile, the method comprising: actuating a linear force using a voice coil coupled to the projectile; converting the linear force to a torque force using a linkage assembly coupled to the voice coil, wherein the linkage assembly comprises a linkage shaft; a slot coupled to the linkage shaft; and a pin loosely coupled to the slot to form a first pivot point, wherein the linkage assembly converts the linear force to the torque force through the first pivot point; and transmitting the torque force to a canard assembly using a second pivot point, wherein the canard assembly comprises a canard shaft coupled to the linkage shaft to form the second pivot point and at least one canard coupled to the canard shaft, and wherein the canard shaft transmits the torque force to the canard to correct the trajectory of the projectile.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE SEVERAL VIEWS OF THE DRAWINGS

The embodiments herein will be better understood from the following detailed description with reference to the drawings, in which:

FIG. 1D illustrates a schematic diagram of an actuator apparatus with a rack and pinion linkage assembly according to an embodiment herein;

FIG. 3 illustrates bearing blocks and support blocks in a linkage assembly;

DETAILED DESCRIPTION OF THE INVENTION

Figure 1A:
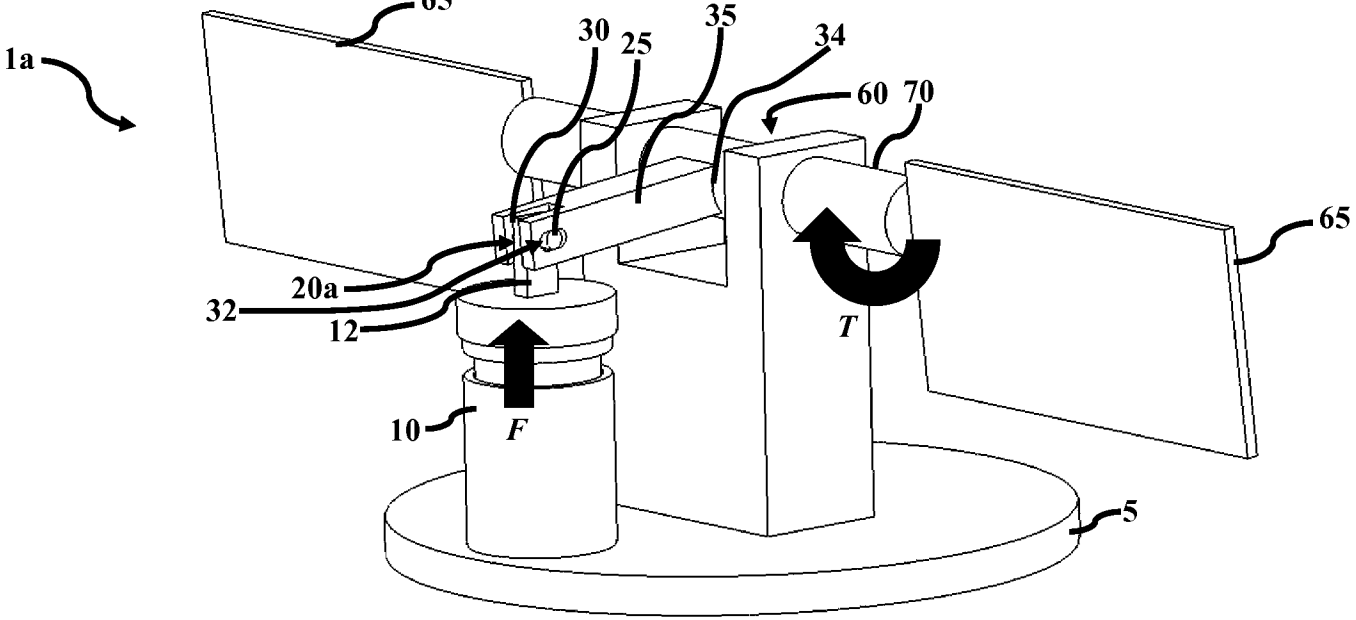
FIG. 1A illustrates a schematic diagram of an actuator apparatus with a pin and slot linkage assembly according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Embodiments described herein provide a two-dimensional (2-D) correction system for accurately correcting both the range and deflection errors inherent in an unguided spin or fin 90 stabilized projectile 99 (e.g., artillery shells, missiles, etc.). This is accomplished by intermittently controlling aerodynamic surfaces (e.g., canards 65) to develop aerodynamic lift and a rotational moment, which nudges the projectile 99 in two dimensions to achieve the desired trajectory. Referring now to the drawings, and more particularly to FIGS. 1A through 5, where similar reference characters denote corresponding features consistently throughout the figures, there are shown preferred embodiments.

FIG. 1A illustrates a schematic diagram of an actuator apparatus 1*a* using a pin 25 and slot 30 linkage assembly 20*a* according to an embodiment herein. According to the embodiment shown in FIG. 1A, actuator apparatus 1*a* includes a voice coil 10, linkage assembly 20*a*, and canard assembly 60—in addition to other components described in further detail below. Furthermore, actuator apparatus 1*a* is shown coupled to base support 5 in FIG. 1A. The embodiment of linkage assembly 20*a* includes a pin 25 and a slot 30 coupled to a linkage shaft 35, where linkage shaft 35 is coupled to canard assembly 60. In addition, voice coil shaft 12 couples pin 25 and slot 30 to voice coil 10. Canard assembly 60 is shown to include a pair of canards 65 and canard shaft 70. As discussed in further detail below, the embodiment of actuator apparatus 1*a* shown in FIG. 1A converts a linear force, F, created by voice coil 10 to a torque force, T, via linkage assembly 20*a* that is then applied to canard assembly 60. Thereafter, the rotary motion of canard assembly 60 (as applied to canard shaft 70) changes the deflection angle of canard 65 relative to a projectile body, not thereby providing a steering force for guided munitions (not shown).

The movement of voice coil 10 is along a linear path (e.g., vertically in the view of FIG. 1A). In the embodiment shown in FIG. 1A, linkage assembly 20*a* converts the linear force, F, generated by a linear motion of voice coil 10 into a torque force (e.g., a rotation) force, T, using pin 25 and slot 30. Pin 25 and slot 30, combined with the linear movement of voice coil 10 transmitted via voice coil shaft 12, create a first pivot point 32. With the linear movement of voice coil 10, first pivot point 32 produces a lateral translation of linkage shaft 35, which consequently creates a second pivot point 34 with canard shaft 70. The lateral translation of linkage shaft 35, when applied to second pivot point 34, translates the linear movement of voice coil 10 to rotational movement in canard shaft 70.

While the configuration of pin 25 and slot 30, shown in FIG. 1A, is one embodiment of an actuator mechanism, embodiments herein are not limited to such an arrangement. For example, other embodiments of such an actuator mechanism are discussed in further detail below. Moreover, those of ordinary skill in the art may be able to identify additional embodiments to those described herein without undue experimentation.

While not shown in the embodiments of FIG. 1A, voice coil 10 provides bi-directional motion (e.g., based on the polarity of an applied voltage, not shown). Through the bi-directional motion of voice coil 10 canards 65 rotate bi-directionally (e.g., back and forth). In addition, voice coil 10 can switch between a discrete number of positions (e.g., on/off) and is controlled via a pulse mode (not shown) to provide a discrete number of positions for canards 65 (e.g., provide two position motion for canards 65). In an alternative embodiment, voice coil 10 can continuously control the angle of canard 65 by providing position feedback and a suitable control circuit (not shown).

Figure 1C:
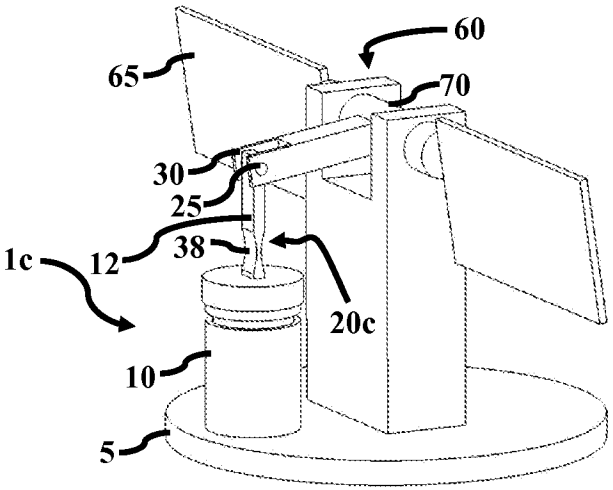
FIG. 1C illustrates a schematic diagram of an actuator apparatus with a flexing linkage assembly according to an embodiment herein.
Figure 1B:
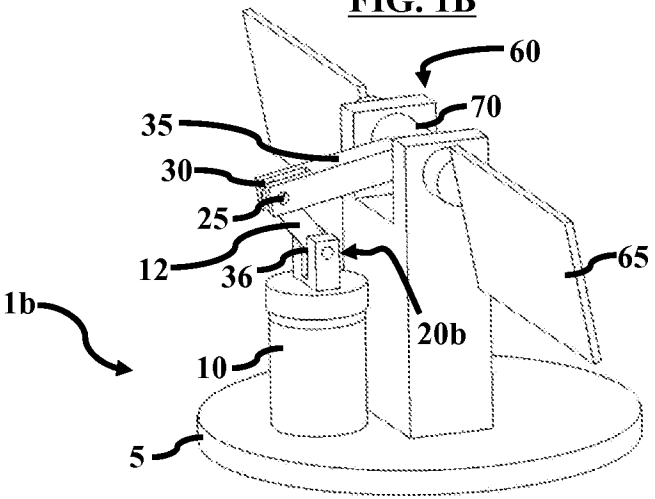
FIG. 1B illustrates a schematic diagram of an actuator apparatus with a linkage assembly according to an embodiment herein.
Figure 2:
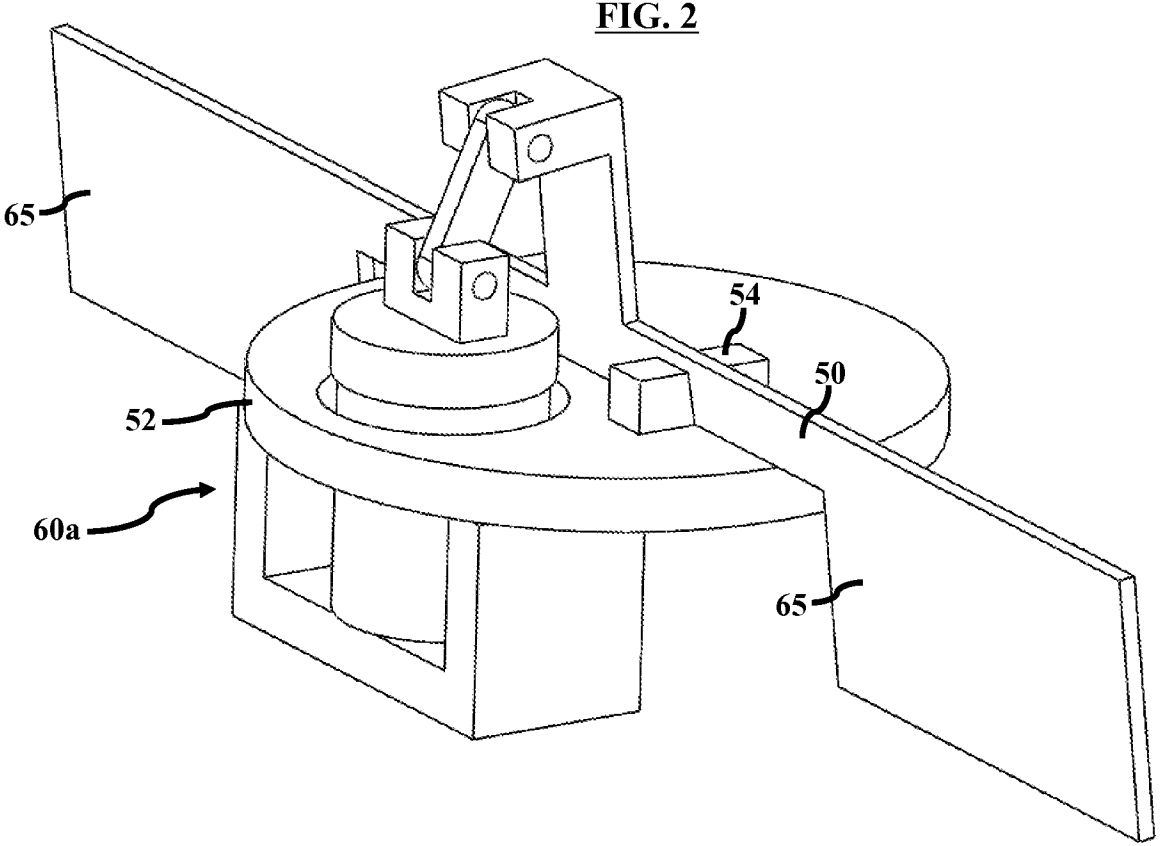
FIG. 2 illustrates a schematic diagram of a canard support assembly according to an embodiment herein.
Figure 3A:
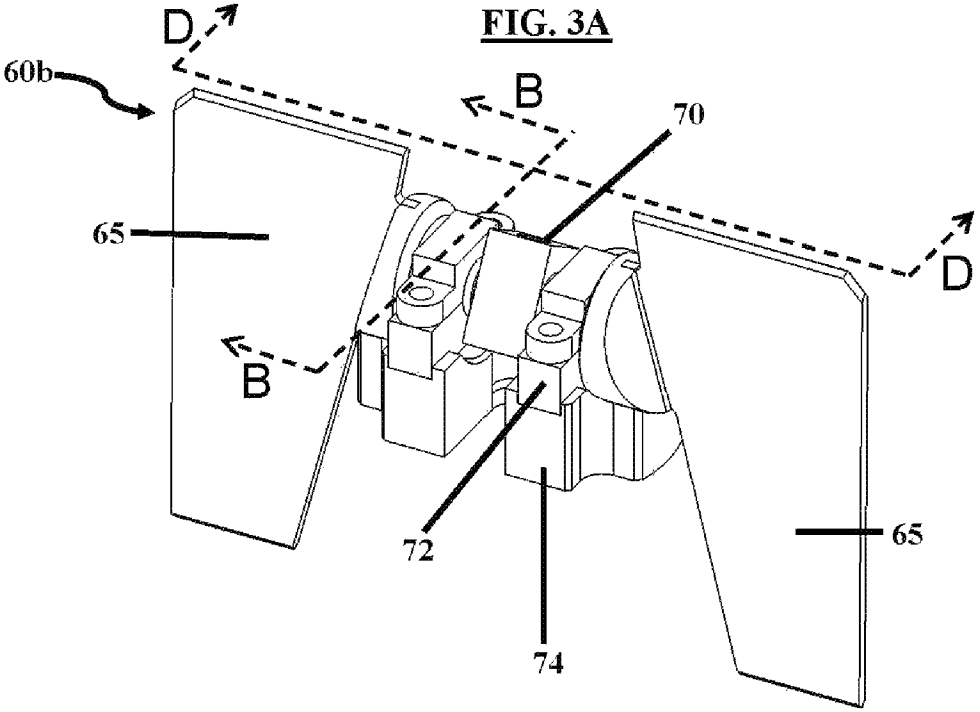
FIG. 3A illustrates a cross-sectional view of an additional canard assembly according to an embodiment herein.
Figure 3B:
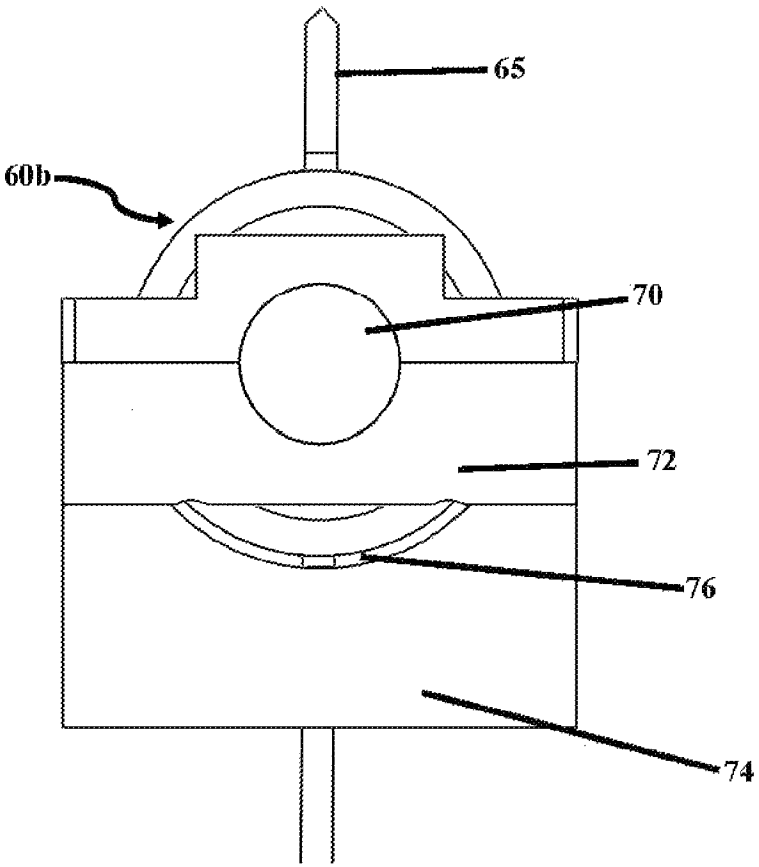
FIG. 3B illustrates a perspective view of the canard assembly shown in FIG. 3A, according to an embodiment herein.
Figure 3C:
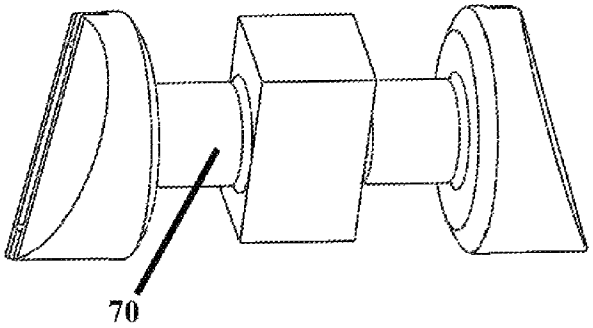
FIG. 3C further illustrates the canard shaft.
Figure 3D:
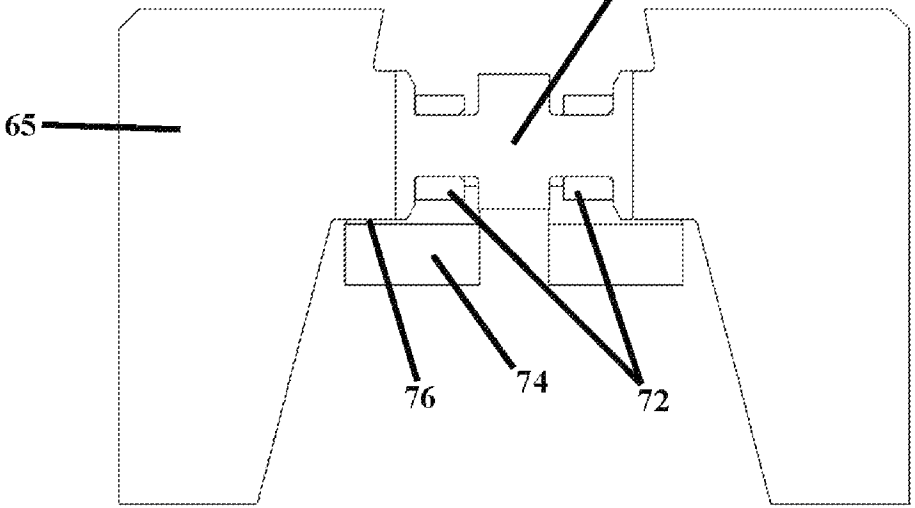
FIG. 3D illustrates a cross-sectional view of canard assembly along line D-D.

FIGS. 1B through 1C illustrate additional embodiments (e.g., actuator apparatus 1*b* and 1*c*) of linkage assembly 20*b*, 20*c*, respectively, and FIGS. 2 through 3B illustrate embodiments of canard assembly 60 (e.g., canard assembly 60*a* and 60*b*). Each of these additional embodiments is discussed in further detail below.

FIG. 1B illustrates a schematic diagram of an actuator apparatus 1*b* with a linkage assembly 20*b* according to another exemplary embodiment described and illustrated herein. In the embodiment shown in FIG. 1B, a third pivot point 36 is created between voice coil shaft 12 and voice coil 10. FIG. 1C illustrates a schematic diagram of an actuator apparatus 1*c* with a flexing linkage assembly 20*c* according to yet another exemplary embodiment described and illustrated herein. As shown, actuator apparatus 1*c* includes a voice coil shaft 12 that includes a flex point 38, located near voice coil 10. Flex point 38 may be due to the material characteristics of voice coil shaft 12; e.g., hardened rubber.

FIG. 2 illustrates a schematic diagram of a canard support assembly 60*a* according to an embodiment herein. As shown in FIG. 2, canard assembly 60*a* includes a flat plate 50 that is coupled to canards 65. In addition, canard assembly 60*a* is supported by disk 52. While not shown in FIG. 2, disk 52 may be or include any support surface of any shape. In particular, the embodiment of disk 52 shown in FIG. 2 supports flat plate 50 via nubs 54. While not shown in FIG. 2, linkage assembly 20*a*-20*d* (shown in FIGS. 1A through 1D, respectively) is coupled to flat plate 50 of canard assembly 60*a*, and when voice coil 10 actuates, linkage assembly 20*a*-20*d* cause canard assembly 60*a* to rock between nubs 54 on disk 52. Moreover, in the embodiment shown in FIG. 2, launch support of canard assembly 60*a* is provided by disk 52.

FIG. 3 illustrates canard assembly 60*b* according to an exemplary embodiment described and illustrated herein. As shown in the exemplary embodiment illustrated in FIG. 3, canard assembly 60*b* includes bearing blocks 72 and support blocks 74, as well as other components discussed below. In the embodiment shown, support of canard assembly 60*b* in high g environments (e.g., during gun launch) is provided by bearing blocks 72 in combination with support blocks 74. While not shown in FIG. 3, bearing blocks 72 may be made from or otherwise include an elastically deformable material—for example, polytetrafluoroethylene (e.g., Teflon® material available from DuPont, Delaware, USA). In addition, Teflon® material provides a non-lubricated, low friction surface that is in contact with canard shaft 70 and assists in the rotation of canards 65.

The embodiment of canard assembly 60*b*, shown in FIG. 3, also includes a clearance gap 76. Under a high g load (e.g., during a gun launch), canard assembly 60*b* exerts a force on bearing blocks 72 to thereby cause an elastic deformation of bearing blocks 72. This elastic deformation of bearing blocks 72 eliminates clearance gap 76. When clearance gap 76 is eliminated, canard assembly 60*b* is supported by support blocks 74. Thereafter, when canard assembly 60*b* is no longer experiencing high g loads (e.g., after a projectile body, not shown, exits a muzzle, not shown), bearing blocks 72 elastically return to their original configuration for lower actuating friction along canard shaft 70.

Figure 4:
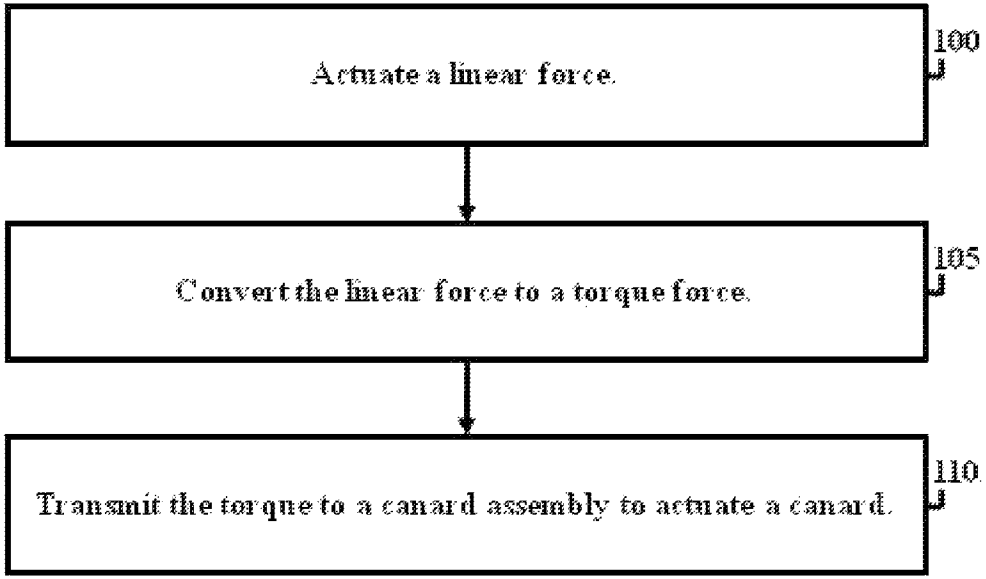
FIG. 4 is a flow diagram illustrating a preferred method according to an embodiment herein.
Figure 5:
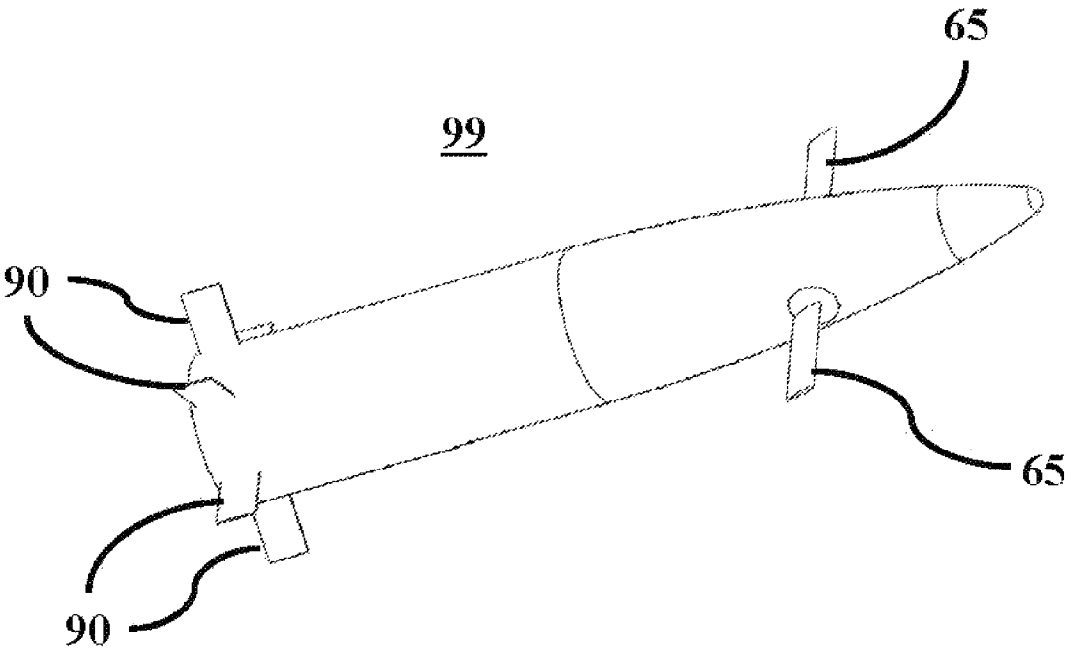
FIG. 5 illustrates a fin-stabilized ballistic projectile having a pair of canards.

FIG. 4, with reference to FIGS. 1A through 3B, illustrates a flow diagram according to an exemplary method embodiment described herein. In the method of FIG. 4, step 100 describes actuating a linear force (e.g., as produced by voice coil 10). Step 105 describes converting the linear force, F, (e.g., as created in step 100) to a torque force, T, (e.g., using linkage assembly 20*a*-20*d* shown in FIGS. 1A through 1D). Next, in step 110, the method of FIG. 4 describes transmitting the torque force, T, (e.g., as created in step 105) to a canard assembly (e.g., canard assembly 60—shown in FIGS. 1A through 1D) to actuate a canard (e.g., canards 65).

The embodiments described herein provide a linear voice coil (e.g., voice coil 10) driven canard actuation mechanism (e.g., canard assembly 60) for use, for example, on gun-launched guided munitions. The linear motion of the voice coil (e.g., voice coil 10) is converted to canard rotation via a linkage (e.g., linkage assembly 12). The canards (e.g., canards 65) are locked in place during launch (e.g., bearing blocks 72 and support blocks 74) and until actuation is needed. The lightweight moving parts are fully supported during gun launch.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A system for correcting range and deflection errors inherent in the trajectory of an unguided, fin-stabilized ballistic projectile, said system comprising:

an unguided, fin-stabilized ballistic projectile, a trajectory control system connected to the projectile and comprising:

a voice coil providing a linear force;

a linkage assembly coupled to said voice coil, said linkage assembly comprising:

a linkage shaft, a slot coupled to said linkage shaft, and a pin loosely coupled to said slot to form a first pivot point, wherein said linkage assembly converts said linear force to a torque force through said first pivot point; and a canard assembly coupled to said linkage assembly, said canard assembly comprising:

a canard shaft coupled to said linkage shaft to form a second pivot point, and one canard coupled to each end of said canard shaft, wherein said torque force is transmitted to the canard shaft by said linkage shaft, and wherein said canard shaft transmits said torque force to each of said canards to change the deflection angle of said canards in unison and develop aerodynamic lift and a rotational moment, thus, correcting range and deflection errors in said trajectory, wherein said canard assembly further comprises:

a plurality of elastically deformable bearing blocks coupled to said canard shaft, and a plurality of support blocks proximate to said plurality of bearing blocks thereby creating a clearance gap between said plurality of bearing blocks and said plurality of support blocks, wherein said plurality of bearing blocks deform under high acceleration to bridge said clearance gap between said plurality of bearing blocks and said plurality of support blocks, and wherein said canard shaft is supported by said support blocks when the clearance gap is eliminated during said deformation.

2. The system of claim 1, wherein said unguided, fin-stabilized ballistic projectile comprises one or more voice coil supports that support said voice coil in an axial direction.

3. The system of claim 1, wherein said linkage assembly comprises:

a voice coil shaft comprising:

a first end, and a second end, wherein said voice coil shaft is coupled to said voice coil to form a third pivot point, and wherein said voice coil shaft is coupled to said voice coil at said first end and coupled to said linkage shaft at said second end using said pin and said slot.

4. The system of claim 1, wherein said linkage assembly comprises:

a flexing linkage member comprising:

a first end, and a second end, wherein said flexing linkage member is coupled to said voice coil at said first end and coupled to said linkage shaft at said second end using said pin and said slot.

5. The system of claim 1, wherein said unguided, fin-stabilized ballistic projectile is configured to be launched from a gun.

6. The system of claim 1, wherein said voice coil rotates said canards bi-directionally and continuously controls the deflection angle of said canards during the flight of the projectile.

7. An apparatus configured to be connected to an unguided, fin-stabilized ballistic projectile for correcting range and deflection errors inherent in the trajectory of said projectile comprising:

a voice coil providing a linear force;

a linkage assembly coupled to said voice coil, said linkage assembly comprising:

a linkage shaft, a slot coupled to said linkage shaft, and a pin loosely coupled to said slot to form a first pivot point, wherein said linkage assembly converts said linear force to a torque force through said first pivot point; and a canard assembly coupled to said linkage assembly, said canard assembly comprising:

a canard shaft coupled to said linkage shaft to form a second pivot point, and at least one canard coupled to said canard shaft, wherein said torque force is transmitted to the canard shaft by said linkage shaft, and wherein said canard shaft transmits said torque force to said to at least one canard to change the deflection angle of said at least one canard to develop aerodynamic lift and a rotational moment, thereby correcting range and deflection errors in said trajectory of said projectile during flight, wherein said canard assembly further comprises:

a plurality of elastically deformable bearing blocks coupled to said canard shaft, and a plurality of support blocks proximate to said plurality of bearing blocks thereby creating a clearance gap between said plurality of bearing blocks and said plurality of support blocks, wherein said plurality of bearing blocks deform under high acceleration to bridge said clearance gap between said plurality of bearing blocks and said plurality of support blocks, and wherein said canard shaft is supported by said support blocks when the clearance gap is eliminated during said deformation.

8. The apparatus of claim 7, wherein said linkage assembly comprises:

a voice coil shaft comprising:

a first end, and a second end, wherein said voice coil shaft is coupled to said voice coil to form a third pivot point, and wherein said voice coil shaft is coupled to said voice coil at said first end and coupled to said linkage shaft at said second end via said pin and said slot.

9. The apparatus of claim 7, wherein said linkage assembly comprises:

a flexing linkage member comprising:

a first end, and a second end, wherein said flexing linkage member is coupled to said voice coil at said first end and said linkage shaft at said second end via said pin and said slot.

10. The apparatus of claim 7, wherein said fin-stabilized ballistic projectile is configured to be launched from a gun.

11. A method of correcting range and deflection errors inherent in an unguided, fin-stabilized ballistic projectile, said method comprising:

providing an unguided, fin-stabilized ballistic projectile;

providing and then connecting a trajectory control system to the projectile, wherein the system comprises:

a voice coil providing a linear force;

a linkage assembly coupled to said voice coil, said linkage assembly comprising:

a linkage shaft, a slot coupled to said linkage shaft, and a pin loosely coupled to said slot to form a first pivot point; and a canard assembly coupled to said linkage assembly, said canard assembly comprising:

a canard shaft coupled to said linkage shaft to form a second pivot point, one canard coupled to each end of said canard shaft, a plurality of elastically deformable bearing blocks coupled to said canard shaft, and a plurality of support blocks proximate to said plurality of bearing blocks thereby creating a clearance gap between said plurality of bearing blocks and said plurality of support blocks, wherein said plurality of bearing blocks deform under high acceleration to bridge said clearance gap between said plurality of bearing blocks and said plurality of support blocks, and wherein said canard shaft is supported by said support blocks when the clearance gap is eliminated during said deformation;

launching the projectile with connected trajectory control system from a gun;

actuating the voice coil to generate a linear force;

converting said linear force to a torque force using the linkage assembly coupled to said voice coil;

transmitting said torque force to the canard assembly using the second pivot point;

wherein said canard shaft transmits said torque force to said canards to correct range and deflection errors in said trajectory of said projectile during flight.

* * * * *